US005645458A

United States Patent [19]

Hotea

[11] Patent Number: 5,645,458

[45] Date of Patent: Jul. 8, 1997

[54] ELECTRICAL RECEPTACLE TERMINAL

[75] Inventor: Gheorghe Hotea, Griesheim, Germany

[73] Assignee: The Whitaker Corporation, Wilmington, Del.

[21] Appl. No.: 555,371

[22] Filed: Aug. 21, 1995

[30] Foreign Application Priority Data

Aug. 19, 1994 [GB] United Kingdom ..... 9416791
Aug. 19, 1994 [GB] United Kingdom ..... 9416870

[51] Int. Cl.[6] ..... H01R 11/22
[52] U.S. Cl. ..... 439/852
[58] Field of Search ..... 439/850–852, 439/856–858, 861, 839

[56] References Cited

U.S. PATENT DOCUMENTS

| | | | |
|---|---|---|---|
| 4,453,799 | 6/1984 | Inoue | 439/857 |
| 4,540,235 | 9/1985 | Lolic | 439/839 |
| 5,007,865 | 4/1991 | Jakobert | 439/856 |
| 5,094,636 | 3/1992 | Zinn et al. | 439/839 |
| 5,288,252 | 2/1994 | Steinhardt | 439/851 |
| 5,334,058 | 8/1994 | Hotea | 439/851 |
| 5,415,571 | 5/1995 | Lutsch | 439/851 |
| 5,468,163 | 11/1995 | Egenolf | 439/851 |

FOREIGN PATENT DOCUMENTS

| | | |
|---|---|---|
| 1124809 | 6/1982 | Canada . |
| 0310487 | 4/1989 | European Pat. Off. . |

*Primary Examiner*—David L. Pirlot
*Assistant Examiner*—Brian J. Biggi

[57] ABSTRACT

An electrical receptacle terminal having forwardly extending and inwardly folded opposing cantilevered contact arms from a box-like structure which further includes at least one port for the receipt of a locking latch of a housing for receiving said receptacle terminal therein, characterized in that a tab extends inwardly from the body portion at the port for abutment by the free end of the contact arm. The tab enables the latching function and the electrical and mechanical function of the contact arms to be effectively isolated from one and other in a one piece receptacle terminal having a protective shell surrounding the contact arms.

11 Claims, 4 Drawing Sheets

ELECTRICAL RECEPTACLE TERMINAL

BACKGROUND OF THE INVENTION

1. Field of the Invention

This invention relates to single piece electrical receptacle terminals having edges or ports for receiving locking members in order to retain the terminal within a connect housing.

2. Description of the Prior Art

It is a continuous requirement in the electrical connector industry, to provide more cost effective, reliable and simple electrical terminals. It is often a further requirement to provide terminals that are stably held within corresponding cavities of a connector housing, and providing a means for securely retaining the terminals within the cavities. It is also often desirable to have high contact forces for improving electrical conductivity between mated contacts, whilst nevertheless reducing the mating force required when coupling complementary connectors. It is also sometimes desirable to provide the resilient locking lances integral with the connector housing rather than stamping resilient locking lances out of the terminal in order to provide a smooth outer surface of the terminal with less risk of entanglement with wires or other objects and less risk of damage to the locking means. It would be desirable to combine as many of the above advantages into a cost effective and simple contact for use in certain applications.

It is known to have a receptacle terminal with a box-like shell portion where a pair of opposing contact arms extend from the forward portion of the box-like structure and are folded inside of the shell to create opposing cantilevered contact arms between which a mating tab terminal may be received. An advantage of this structure is that the contact arms are disposed within a protective outer shell that prevents the contact arms from being damaged and a smooth surface is presented for insertion into a passageway of a connector housing. It is further known to incorporate ports along the box-like structure for receiving resilient locking arms of the housing wherein the terminal is to be received that engage the terminal to prevent the terminal from backing out of the housing. It is further known to allow the free ends of the contact arms to abut the inner sides of the shell in order to provide the contact arms with sufficient stiffness for a wiping engagement with the tab terminal.

SUMMARY OF THE INVENTION

It is therefore an object of this invention to provide a single piece stamped and formed electrical receptacle terminal that is cost effective yet has high contact force and low mating forces.

It is a further object of this invention to provide a single piece stamped and formed electrical receptacle contact that makes sufficient use of the sheet material from which it is stamped, yet has high contact forces, low mating forces and is robust and reliable.

What is still needed is an electrical receptacle terminal that incorporates the above mentioned desirable features while assuring that the latching function within the housing and the electrical and mechanical function of the contact arms remain separate from each other. It is further needed to provide a way to assure that the contact arms need not be unnecessarily long to be supported by back up structure.

The objects of this invention have been achieved by providing a single piece electrical receptacle contact stamped and formed from sheet metal comprising a connection section for connection to a conductor, extending axially into a box-shaped body section having contact arms extending axially therefrom having contact surfaces for receiving a complementary type contact therebetween, the contact arms extending into a box-shaped mating end section, the box-shaped mating end section having tabs projecting axially rearwards therefrom to provide a locking edge for engagement with a locking projection of a connector housing, the tab locking edge situated at roughly the same axial position as the contact surface of the contact arms. Embodiments may include pairs of opposed contact arms attached to the box-section and to the mating end section, the two arms of the pair being separated by a slot and having the locking tab positioned therebetween.

Another object of the invention is accomplished by providing an electrical receptacle terminal having forwardly extending and inwardly folded opposing cantilevered contact arms from an open end of a box-like structure which further includes at least one port for the receipt of a locking latch of a housing for receiving said receptacle terminal therein, characterized in that a tab extends inwardly from the body portion at the port for abutment by the free end of the contact arm.

Advantageously, the tab isolates the locking latch function from the electrical engagement function of the contact arms as the contact arm is held inward of the port region where the latch would be received. Further advantageously, the tab, by being folded inwardly, extends over some of the area of the port enabling insertion of the locking latch while still providing a backup surface for abutment by the free end of the contact arms in the general vicinity of the port. Finally, the structure is economical, easy to manufacture and enables the use of shorter contact arms.

DETAILED DESCRIPTION OF THE PREFERRED EMBODIMENT

Figure 1:
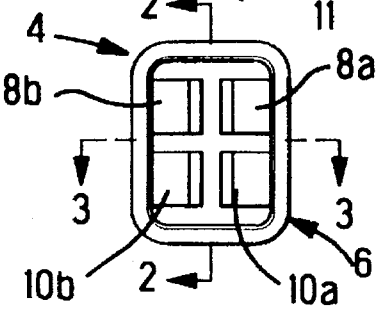
FIG. 1 is a front view of a receptacle terminal according to the present invention.

With reference first to FIG. 1, a receptacle terminal according to the present invention is shown generally at 2. As used herein, terms such as: "forwardly", "inwardly", etc. are meant solely for ease of description in relation to the drawings and are not meant to limit the invention. The electrical terminal 2 includes a contact portion 4 that includes a box-like outer shell 6 having two pairs of opposing and inwardly folded cantilevered contact arms 8*a,b* and 10*a,b* for engaging in a mating tab terminal (not shown) at a forward end 7. It should be noted that a larger or lesser number of contact arms may be advantageously incorporated into this design.

Figure 2:
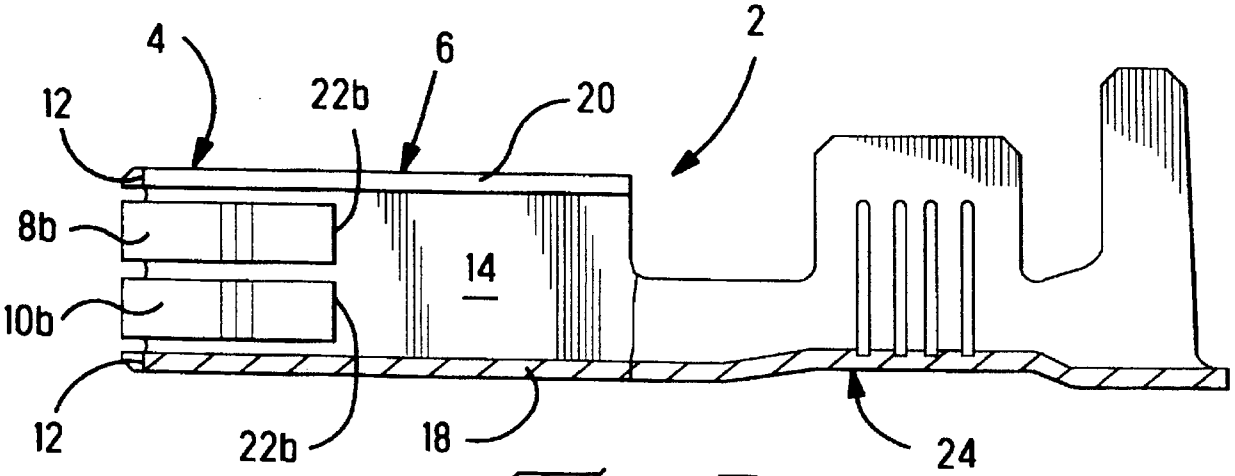
FIG. 2 is a side sectional view taken along line 2—2 of the receptacle terminal of FIG. 1.
Figure 3:
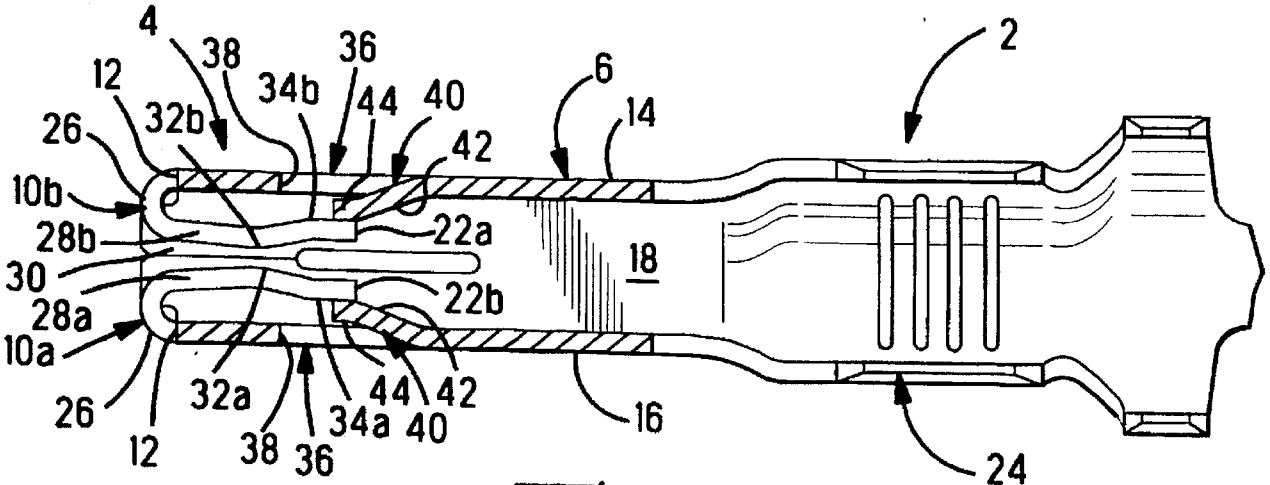
FIG. 3 is a top sectional view taken along line 3—3 of the receptacle terminal of FIG. 1.

As best seen in FIG. 2 and FIG. 3, the contact arms 8,10 extend forwardly from a front edge 12 opposing sides 14,16 of a four sided box-like structure 6. The box structure further includes a bottom surface 18 and upper surface 20. The upper surface 20 is formed of two halves joined along a seam by laser welding or mechanical means. Each contact arm 8,10 includes a free end 22 located inside the box-like structure 6.

At the opposite end of the terminal 2 is a conductor receiving end 24, which in this embodiment is advantageously configured for a crimping interconnection with the conductor of an insulated wire. It should be noted that other conductor engaging configurations may be incorporated into the present invention.

With reference now to FIG. 3, the contact arms 8,10 are inwardly folded to the interior of the box 6 through nose 26. The nose section 26 is formed in a loose radius and provides guidance when inserting a mating tab terminal (not shown), or inserting the receptacle terminal 2 into a housing and further acts in providing the contact arms 8,10 with the desired resilience for engaging the mating tab terminal. The nose 26 is followed by an inwardly tapering section 28 that define a contact engaging section 30 at opposing contact surfaces 32*a,*32*b* of the opposing contact arms 8*a,b;*10*a,b*. The contact surfaces 32*a,b* may be initially abutting or spaced apart, as shown in this embodiment, provided they are close enough together to engage the tab terminal. The contact arm 8,10 then diverge outwardly to free ends 22 which are shown in abutting engagement with backup surfaces 34, as will be described below.

Incorporated into each of the sides 14,16 of the box 6 are ports 36. These ports 36 include a forward abutment shoulder 38 that is engagable by a locking latch (not shown) of the connector housing to prevent the terminal from being removed from the connector housing, as is well known in the industry. At the rear end of the port 36 is a tab 40. Each tab 40 includes an inwardly inclined surface 42 extending forwardly along the backup surface 34 to a free end 44. The free end 44 is constructed to extend into and define the port 36 so that the backup surface 34 is overlapped by the free end 22*a* of the contact arm 8,10 in a supporting manner.

As further shown in FIG. 3, as the tab 40 is part of the box 6 and holds the contact arm 8,10 away from the interior surfaces of the side walls 14,16 the latch and the contact arms will be prevented from interfering with each other. This is further advantageous in that the contact arm 8,10 is protected from damage by the latch. Additionally, the latching function and the tab engaging function of the contact arms 8,10 are effectively isolated from each other. Furthermore, as the tabs 40 extend forwardly into the port area 36, the contact arms 8,10 may be supported by the material that must be removed anyway to form the ports 36. This enables economical manufacturing and allows the support to be provided where it is most desired as opposed to it being necessary to extend the contact arms further along the inside of the box 6.

Figure 4:
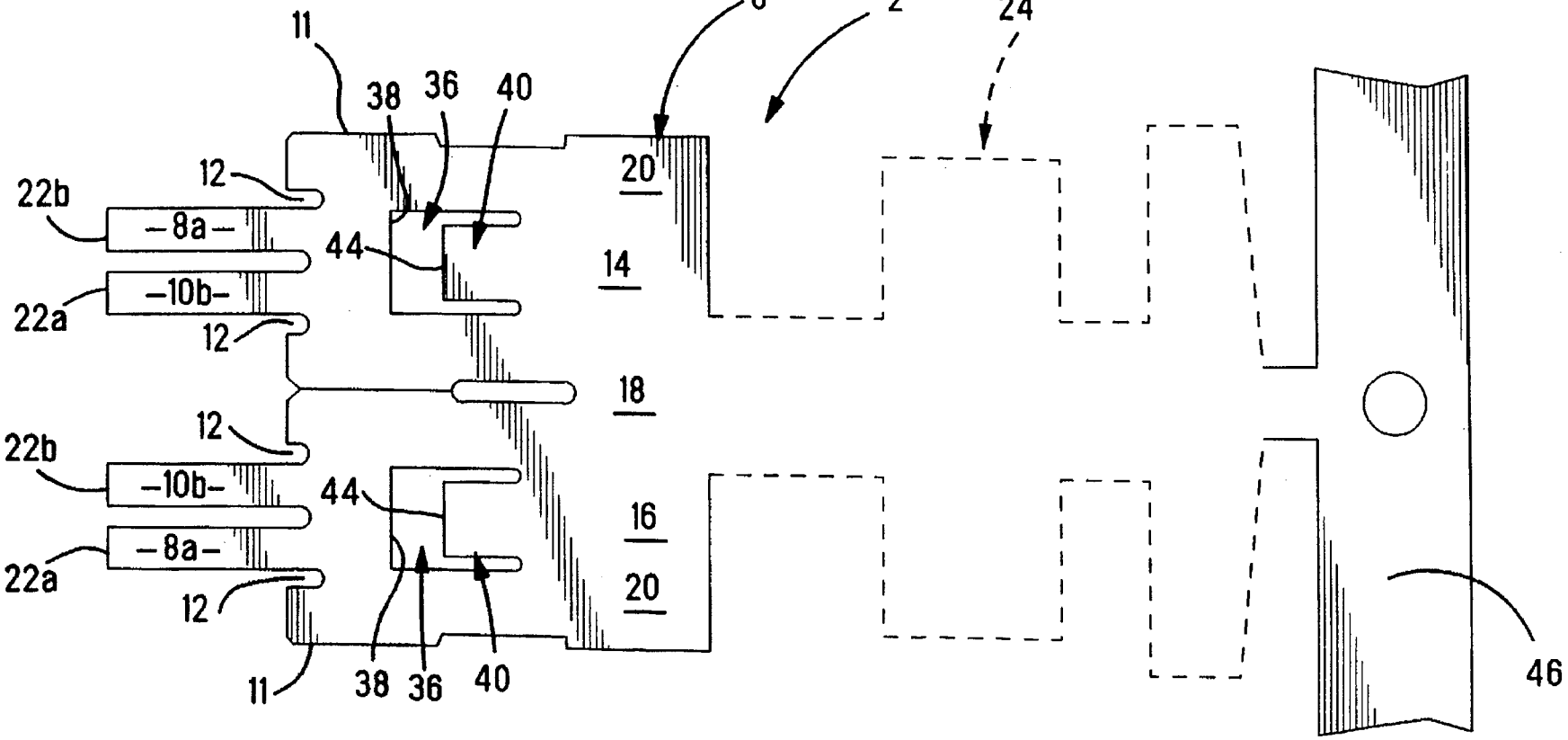
FIG. 4 is a plan view of the blank used to form the receptacle terminal of FIG. 1.

With reference now to FIG. 4, a plan view of the blank used to create the electrical terminal 2 is shown. In this plan view, the relevant features of the terminal 2 that have been described above are indicated with corresponding reference numbers. It is extremely useful to the understanding of this invention to compare the plan view of FIG. 4 to those presented in FIGS. 1–3. As can be seen in the plan view, the tabs 40 extend forwardly into the port area 36 and the contact arms 8,10 may be seen extending forwardly from the front edges 12 of the sides 14,16. Furthermore, it is readily apparent that a blank incorporating the present invention may be easily formed in a single operation and transported for manufacturing purposes along a carrier strip 46 where conventional forming techniques may be applied to form the finished contact. Finally, joining the top of the box 6 together along seam 11 by such techniques as laser welding or mechanical affixation.

Figure 5:
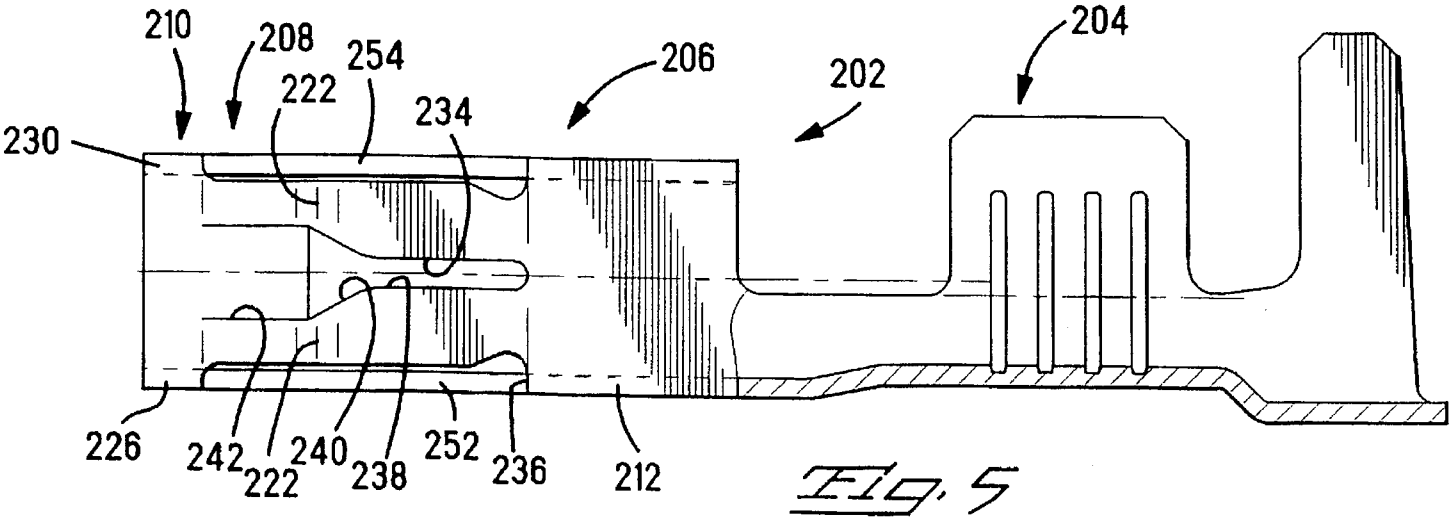
FIG. 5 is a side, partial cross-sectional view of another single piece receptacle contact.
Figure 6:
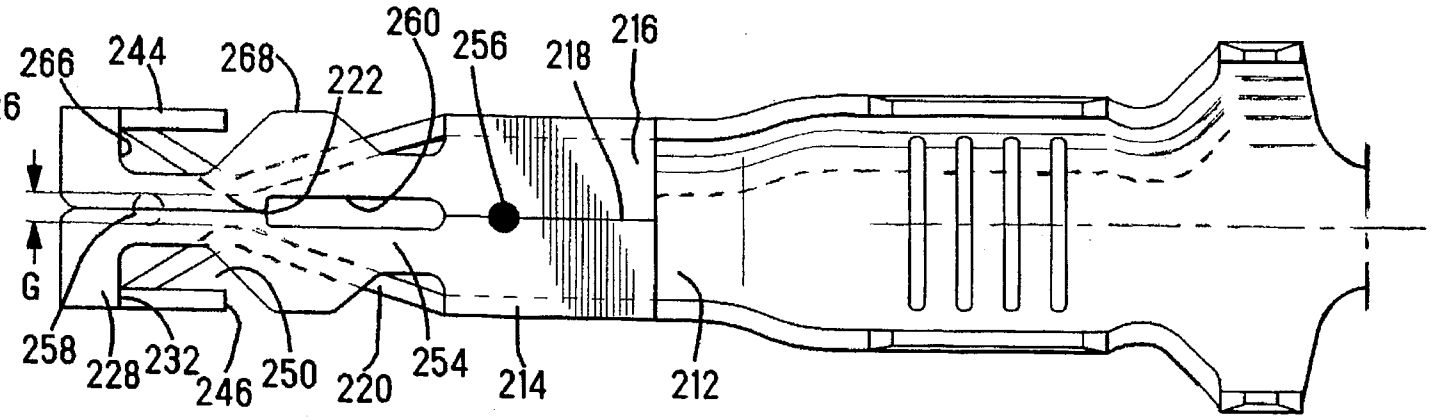
FIG. 6 is a view in the direction of arrow 2 of FIG. 5.
Figure 7:
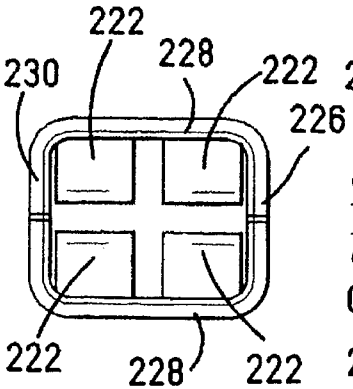
FIG. 7 is a view in the direction of arrow 3 of FIG. 6.

Referring to FIGS. 5–7, an electrical receptacle terminal 202 comprises a connection section 204 having crimping barrels for crimped electrical connection 202 conducting strands of an electrical wire, the connection section 204 axially extending into a box-shaped body section 206 extending axially into a contact section 208 which further extends axially into a box-shaped mating end section 210. The body section 206 comprises a base wall 212, side walls 214 extending orthogonally from lateral edges thereof, and a top wall 216 having a central seam 218 resulting from the folding together of the sheet metal from which the terminal is stamped.

The contact section 208 comprises a pair of opposed contact arms 220 that converge to contact points 222 that are spaced apart by a gap G, the contact arms then diverging therefrom until the mating end section 210. The mating end section 210 comprises a bottom wall 226, side walls 228 extending orthogonally from lateral edges thereof, and a top wall 230; the bottom, side and top walls being aligned axially with the bottom side and top walls of the body section 206.

The contact arms 220 are attached integrally to the mating end section 210 at a rear edge 232 thereof. The pair of contact arms 220 are separated by a slot 234 that begins at approximately the same axial position as a front end 236 of the body section 206, and extends up to approximately the same axial position as the rear end 232 of the mating section 210. The slot 234 comprises a thin rear portion 238 extending into a diverging transition section 240 which further extends into a larger section 242. The intersection of the transition and large sections 240,242 is at approximately the same axial position as the contact points 222. A pair of opposed tabs 244 extend rearwardly from the sidewalls 226 of the mating end section 210 and are substantially aligned and parallel to the side walls 228,214 and extend to a rear locking edges 246 that are positioned approximately at the same axial position as the contacts 222. The tabs 244 are in fact stamped out of the large slot 242 and are substantially the same width. The locking edge 246 thus provides an edge behind which a locking protrusion of a connector housing (not shown) can be positioned for securely locking the terminal therein. The locking edge 46 is positioned approximately at the same level as the contacts 222 thus providing a space 250 therebetween for the locking protrusion of the housing to protrude without touching and affecting the contact arms 220.

The spaced apart pairs of contact points 222 can move relative independently of each other and thus provide more optimal contact force and conductivity than a single contact arm. Furthermore, as the opposed contact arms 220 are separated by gap G between the contact points 222, mating forces with a complementary male contact are reduced as the initial force required to separate the contact arms is less than conventional cantilever beam contacts where the contact points touch each other in the uncoupled state. The contact arms 220 are flanked by top and bottom walls 252,254 that extend between the top and bottom walls 230,216 and 226,212 of the body section and mating section 206,210. The top and bottom walls 252,254 are joined to the mating end section 210 at the rear edge 232 and thus provide additional spring strength to the contact arms 220. For very high contact pressure of the contact points 222 against the mating male tab, the seam 218 could be held together, for example by welding with a laser, not only at the body section with the laser weld 256, but also proximate the mating intersection with the laser weld 258 thus preventing opening of the seam 218. If however greater flexibility and a softer resiliency of the contact arm 220 is desired, the seam 218 could be left unjoined proximate the mating intersection (joined only at the body section) and the lower wall 252 could be provided with a central axial seam 219 to allow resilient biasing apart thereof. An oblong slot 260 can also be provided in the top and bottom walls 250,254 for varying the resiliency of the top and bottom walls and thus the resiliency of the contact arms 220 depending on the application.

Cutouts 266 in the top and bottom walls 252,254 can also be provided proximate the mating end section 210 to increase the resiliency of the contact arms 220. Central protrusions 268 in the top and bottom walls 252,254 may be provided for increasing the stability of the terminal within a corresponding cavity of the housing and for preventing tangling with leads or seals during assembly.

Figure 8:
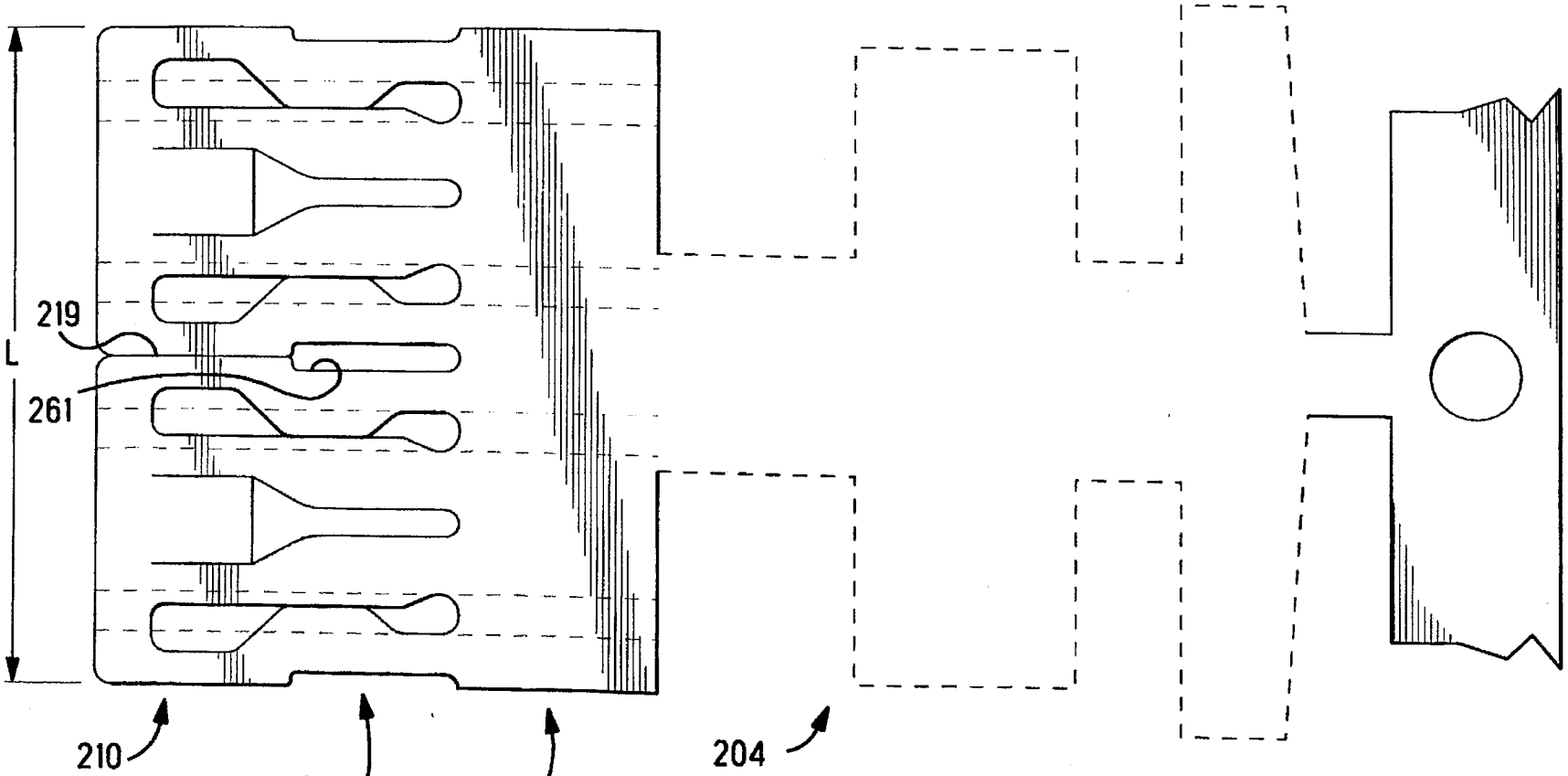
FIG. 8 is a view of a partially stamped contact illustrating its developed shape.

Referring to FIG. 8, the developed layout of the contact prior to forming into box-shape, shows the optimal use of material whereby the width of the sheet metal strip is substantially determined by the sum of the length of the side walls and top and bottom walls L. From the body section to the mating intersection very little material is stamped out and use of the material is thus effective and efficient whilst nevertheless providing a contact with high contact pressure, reduced insertion force when mating with a complementary tab, and a compact outer shape that can be stably held within a corresponding housing cavity. The use of the space 250 behind the contacts 222 of the contact arms 220 for housing locking protrusions is an example of the effective use of volume around the contact for the locking function.

Advantageously therefore, the contact is simple, cost-effective, compact whilst providing high contact force and low mating forces. Furthermore, the contact can be stably held within a corresponding housing cavity.

I claim:

1. A one piece electrical receptacle terminal comprising a box-like structure with opposing cantilevered contact arms that extend forwardly from the box-like structure through a reverse bent nose section such that free ends of the contact arms are within the box-like structure, where the box-like structure further includes at least one port for the receiving a locking latch of a housing therein, the receptacle terminal being characterized in that a tab extends inwardly into the interior of the box-like structure from the box-like structure at the port for supporting abutment by the free end of the contact arms as a mating terminal is inserted therebetween.

2. The electrical receptacle terminal of claim 1, further characterized in that the tab is formed from the material removed from the box-like structure to define the port.

3. The electrical receptacle terminal of claim 1, further characterized in that the port includes a forward edge for cooperating with the latch to prevent the terminal from backing out where the forward edge is located forward of the free end of the contact arm.

4. The receptacle terminal of claim 1 where the box-like structure has four sidewalls that include two opposing sidewalls spanned by spaced apart and opposing bottom and upper walls, the tabs being folded inward from the opposing sidewalls and positioned to support the contact arms such that the free ends of the contact arms are prevented from deflecting against the interior of the box-like structure as a result of insertion of the complementary contact.

5. The receptacle terminal of claim 4 where the contact arms also extend from the opposing sidewalls.

6. A stamped and formed single piece electrical receptacle terminal comprising a connection section for electrical connection to a conductor, a box-shaped body section connected to the connection section that is formed by bottom, top and sidewalls extending axially therefrom, and having a contact section, the body section for mating with a complementary contact insertable therein, and a box-shaped mating end section, located opposite the connection section through which the complementary contact passes to be received in the contact section and formed by bottom, top and sidewalls substantially in alignment with the box-shaped contact section, characterized in that the contact section comprises contact arms extending between the body and mating end sections and converging to contact points spaced apart by a gap slightly smaller than the thickness of the complementary contact, the contact arms having an axial slot extending rearwardly from the mating end section and from which a tab is stamped, the tab extending substantially parallel to the sidewalls and rearwardly therefrom to a locking edge approximately axially positioned over the contact points and forming a space therebetween for positioning a connector housing locking protrusion therein and against the locking edge.

7. The terminal of claim 6 characterized in that the contact arms are integrally attached at both axial ends to the mating end section and body section side walls respectively.

8. The terminal of claim 7 characterized in that axially extending seams are provided in the top and bottom walls of the mating end and contact sections respectively for increasing the resiliency of the contact arms.

9. The terminal of claim 7 characterized in that the contact section top and bottom walls have protrusions extending to the plane of the sidewalls for increasing the stability of the terminal within a corresponding housing cavity.

10. The terminal of claim 6 characterized in that the slot is of varied width for adjusting the resiliency of the contact arms.

11. The terminal of claim 6 characterized in that the top and bottom walls of the contact section have cut-outs extending from outer edges towards a central portion for reducing the stiffness thereof thereby increasing the resiliency of the contact arms.

* * * * *